United States Patent [19]

Boyette

[11] Patent Number: 4,516,449

[45] Date of Patent: May 14, 1985

[54] TOOL HOLDER WITH WORK RELEASE MECHANISM

[76] Inventor: Bobby R. Boyette, 11519 Belton Dr., Dublin, Calif. 94566

[21] Appl. No.: 558,390

[22] Filed: Dec. 5, 1983

Related U.S. Application Data

[63] Continuation-in-part of Ser. No. 364,462, Apr. 1, 1982, abandoned.

[51] Int. Cl.[3] ..... B26F 1/14; B21D 45/00

[52] U.S. Cl. ..... 83/140; 83/136; 83/698

[58] Field of Search ..... 83/140, 136, 137, 138, 83/139, 141, 698

[56] References Cited

U.S. PATENT DOCUMENTS

| | | | |
|---|---|---|---|
| 2,882,971 | 4/1959 | Bennett et al. | 83/140 |
| 3,429,212 | 2/1969 | Weisbeck | 83/140 |
| 3,540,339 | 11/1970 | Killaly | 83/140 |
| 3,815,459 | 6/1974 | Daniels | 83/140 |

*Primary Examiner*—Donald R. Schran

*Attorney, Agent, or Firm*—Harris Zimmerman; Howard Cohen

[57] ABSTRACT

An improved tool holder for stripping work pieces from dies includes a cylindrical mandrel having a slotted boss extending axially from the upper end thereof. A plurality of tapped holes and a plurality of spring receiving holes extend into the upper end of the mandrel parallel to the axis thereof. A tubular collar includes a closed lower end having an axially disposed hole for receiving the slotted boss of the mandrel therethrough. The closed end of the collar includes a plurality of holes aligned with the spring holes and tapped holes of the mandrel. A piston is slidably received within the collar and about the boss, and includes a resilient bumper projecting outwardly from the end thereof. A first plurality of screws extends through the closed end of the collar and is received in tapped holes in the piston, the heads of the first plurality of screws being disposed in the spring receiving holes of the mandrel. A second plurality of screws extends from the closed end of the collar and are received within the tapped holes of the mandrel. When the bumper end of the piston is driven against a work piece, the heads of the first screws impinge upon the springs and permit resilient retraction of the piston within the assembly, exposing the tip of a punch or the like supported within the mandrel. As the tool holder retracts from the workpiece, the piston pushes the workpiece out of engagement with the punch, freeing the punch from the work.

3 Claims, 6 Drawing Figures

TOOL HOLDER WITH WORK RELEASE MECHANISM

REFERENCE TO RELATED APPLICATION

This application is a continuation-in-part of application Ser. No. 364,462, filed Apr. 1, 1982, abandoned, entitled TOOL HOLDER WITH WORK RELEASE MECHANISM.

BACKGROUND OF THE INVENTION

The following United States patents comprise the closest known prior art: U.S. Pat. Nos. 4,007,653, 3,901,111, 3,835,691, 3,335,627, 3,212,143, 3,079,823, 1,271,798.

In the metalworking arts, it is a common practice to use some device to remove or strip a metal workpiece from the die of a forging or stamping machine. Often the device used comprises a standard punch holder, a tool well known to the skilled craftsman. The punch holder is modified by the provision of a resilient bumper mounted on the punch holder in place of the usual metal punch.

These devices exhibit certain drawbacks which make them undesirable in some forging or stamping processes. For example, the punch holder provides direct impact on the workpiece, with the only cusioning effect being provided by the resilient bumper. If the length of travel of the work-stripping punch is not precisely controlled, the work stripper can exceed its resilient limits and damage the workpiece. The hard impact can also mar the surface of the workpiece, resulting in quality control problems. Furthermore, the resilient bumper undergoes severe stress and strain, and typically fails after relatively brief usage.

SUMMARY OF THE PRESENT INVENTION

The present invention generally comprises an improved tool holder for stripping workpieces from forging and stamping dies. The salient features of the invention are an improved construction which permits a resilient impact upon the workpiece, and which is also easy to setup and disassemble.

The improved tool holder of the present invention includes a cylindrical mandrel having a slotted boss extending axially from the upper end thereof. A plurality of tapped holes and a plurality of spring receiving holes extend into the upper end of the mandrel parallel to the axis thereof. A tubular collar includes a closed lower end having an axially disposed hole for receiving the slotted boss of the mandrel therethrough. The closed end of the collar includes a plurality of holes aligned with the spring holes and tapped holes of the mandrel. A piston is slidably received within the collar and about the boss, and includes a resilient bumper projecting outwardly from the end thereof. A first plurality of screws extends through the closed end of the collar and is received in tapped holes in the piston, the heads of the first plurality of screws being disposed in the spring receiving holes of the mandrel. A second plurality of screws extends from the closed end of the collar and are received within the tapped holes of the mandrel, joining the collar to the mandrel. When the bumper end of the piston is driven against a work piece, the heads of the first screws impinge upon the springs and permit resilient retraction of the piston within the assembly. This action exposes the tip of a punch or the like which then penetrates the sheet metal workpiece.

As the tool holder retracts, the resilient piston action pushes the sheet metal off of the punch, thereby freeing the workpiece from the punch.

A BRIEF DESCRIPTION OF THE DRAWING

DESCRIPTION OF THE PREFERRED EMBODIMENT

The present invention generally comprises an improved tool holder which is adapted to more effectively strip or release work pieces from a metal working die or the like. A salient feature of the present invention is the provision of a resilient bumper piston which more effectively removes the work piece from the die without damaging the work piece.

Figure 1:
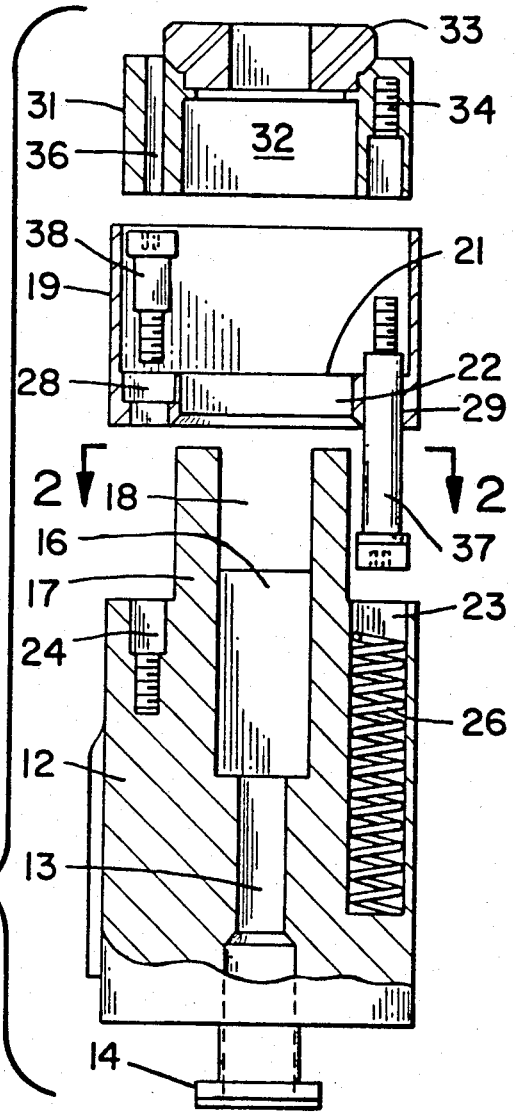
FIG. 1 is an exploded cross-sectional view of the components of the improved tool holder of the present invention.
Figure 4:
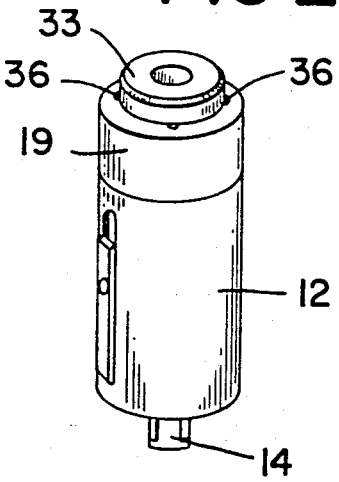
FIG. 4 is a perspective view of the improved tool holder assembly of the present invention.

With reference to FIG. 1, the improved tool holder includes a generally cylindrical mandrel 12 which is provided with a bore 13 extending axially therethrough and a T member 14 extending axially from the lower end thereof. The upper end of the mandrel includes a generally cylindrical boss 17 extending axially therefrom, with a couterbore 16 aligned with and joining the bore 13. A slot 18 extends transversely to the axis of the mandrel and is disposed in the end of the cylindrical boss 17. The mandrel 12 and the features 14–18 thereof are commonly found in tool holders known in the prior art, such as punch holders and the like.

Figure 2:
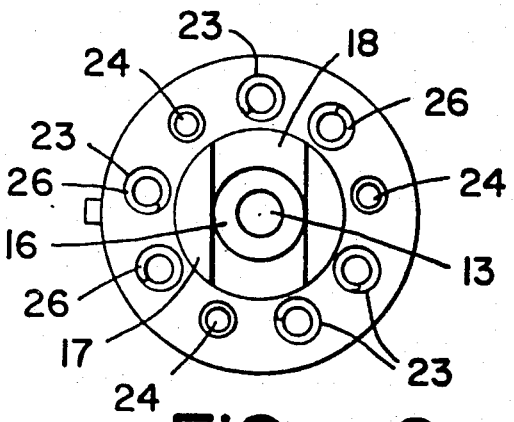
FIG. 2 is an end view of a portion of the present invention, taken along line 2—2 of FIG. 1.
Figure 5:
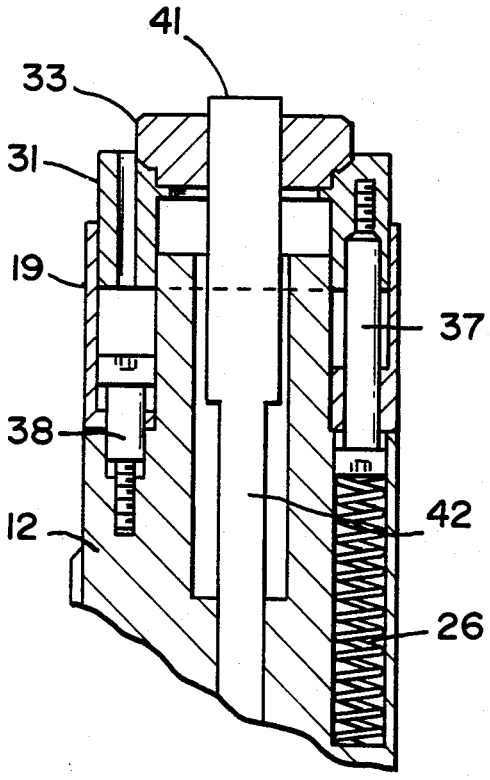
FIG. 5 is a partial cross-sectional elevation of the tool holder assembly of the present invention, shown supporting a punch in an extended, work-engaging disposition.

In accordance with the present invention, the mandrel 12 is further provided with a plurality of holes 23 extending parallel to the axis of the mandrel and angularly spaced thereabout in pairs, as shown in FIG. 2. Furthermore, the mandrel also includes a plurality of tapped holes 24 extending parallel to the axis thereof, each hole 24 being disposed between a pair of the holes 23. Disposed within each of the holes 23 is a helical compression spring 26.

The invention also includes a cylindrical, tubular collar 19 having a flange 21 extending radially inwardly at the lower end thereof. The flange 21 defines a hole 22 extending axially in the collar, the hole 22 being dimensioned to receive therethrough the generally cylindrical boss 17 in freely translating fashion. The flange 21 is provided with a plurality of counterbored holes 28 extending parallel to the axis, each of the holes 28 being disposed to align with one of the holes 24 in the mandrel. The flange 21 also includes a plurality of holes 29 extending parallel to the axis, each of the holes 29 being disposed in alignment with one of the spring receiving holes 23.

The invention also includes a cylindrical, tubular piston 31 which is provided with an outer diameter to permit free translation of the piston within the collar 19. The piston 31 includes an inner bore 32 which is sufficient in diameter to receive the cylindrical bore 17 in freely translating fashion. Disposed in the upper end of the bore 32 is a resilient bumper 33 which is provided for reasons to be explained in the following description.

The piston 31 includes a plurality of tapped holes 34 extending into the lower end thereof parallel to the axis, each of the holes 34 being disposed in alignment with one of the holes 29 of the collar 19. The piston 31 also includes a plurality of access holes 36, each comprising a narrow hole extending through the piston parallel to the axis and disposed in alignment with the holes 28 of the collar 19.

A plurality of machine screws 37 extend upwardly through the holes 29 in the collar 19 to be threadedly received in the holes 34 of the piston 31. The screws 37 are translatably disposed in the holes 29, and the heads of the screws 37 are dimensioned to be received within the upper portions of the holes 23 in the mandrel 12. The screws 37 effectively transmit any force from the piston 31 to the springs 26 on which the heads of the screws 37 are supported. The screws 37 also join the collar 19 and the piston 31 in a sub-assembly, the screws 37 providing limited axial travel of the piston 31 within the collar 19.

Figure 3:
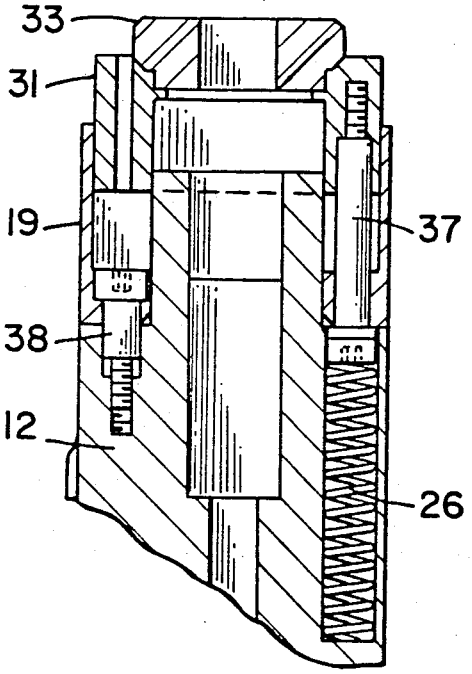
FIG. 3 is a partial cross-sectional elevation of a portion of the tool-holder assembly of the present invention.

A plurality of machine screws 38 extend from the collar 19 through the holes 28 to be threadedly received in the holes 24 of the mandrel 12. The screws 38 thus join the sub-assembly of the piston and collar to the mandrel 12. The screws 38 are provided with socket heads and the holes 36 in the piston 31 provide access to the heads of the screws 38 with an allen wrench or the like. The screws 38 retain the collar 19 and the mandrel 12 in rigid fashion. The complete assembly is shown in FIG. 3.

Figure 6:
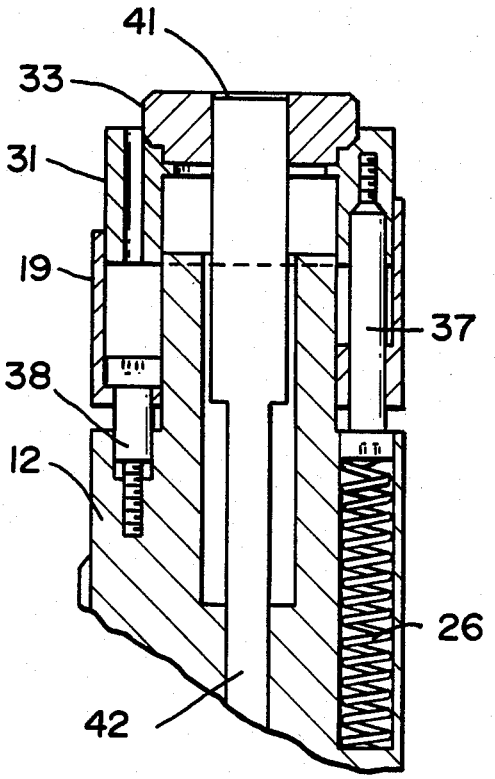
FIG. 6 is a view as in FIG. 5, shown with the punch in the retracted position.

The complete assembly of the present invention may be joined to a punch supporting portion of a machine tool, using the T member 14, as is well known in the prior art. The improved tool holder of the present invention may then be employed to strip a work piece from the metal working die or the like. To do this, the tool is driven axially so that the bumper 33 impinges upon the work piece. When this action occurs, the force of impact is transmitted from the bumper 33 and the piston 31 through the screws 37 to the springs 26 in the mandrel. The piston will retract under the impact force, causing the springs 26 to compress, and exposing the tip 41 of a punch or the like supported in mandrel 12. Due to the fact that the punch shank 42 is fixedly secured in the mandrel, the retracting piston permits the tip 41 to impact upon the workpiece, such as a sheet metal web. The tip then pierces the metal to form the desired hole. As the tool holder withdraws from the workpiece, the resilient restoring force of the springs 26 causes the piston to extend once again, as shown in FIG. 6. The piston thus effectively causes the punch tip to withdraw into the piston. If the sheet metal work piece has adhered to the punch tip, the extending piston will push the sheet metal off of the punch, freeing the tool from the work piece.

I claim:

1. An improved tool holder for supporting a tool and stripping work pieces from the tool, including; a cylindrical mandrel having a boss extending axially from one end thereof, a first plurality holes extending into said one end and disposed parallel to the axis of said mandrel, said first plurality of holes being tapped a second plurality of holes extend into said upper one end of said mandrel parallel to said axis, for receiving springs therein a tubular collar secured to said one end of said mandrel and received about said boss, a bumper piston disposed within said collar and about said boss in freely translating fashion, a plurality of compression springs each disposed in one of said second plurality of holes, first screw means extending from said collar and secured in said first plurality of tapped holes, and second screw means extending through said collar and secured in said bumper piston, said second screw means including distal portions impinging on said compression springs in said second plurality of holes.

2. The improved tool holder of claim 1, further including a resilient bumper secured to the outer end of said bumper piston.

3. The improved tool holder of claim 1, further including a plurality of access holes extending into said outer end of said piston and aligned with said first screw means.

* * * * *